US008059494B2

(12) United States Patent
Veuthey et al.

(10) Patent No.: US 8,059,494 B2
(45) Date of Patent: Nov. 15, 2011

(54) WATER RESISTANT PORTABLE OBJECT INCLUDING A SOUND GENERATOR

(75) Inventors: Jean-Bernard Veuthey, Marin (CH); Stéphane Claude, Grenchen (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 207 days.

(21) Appl. No.: 11/913,992

(22) PCT Filed: Apr. 28, 2006

(86) PCT No.: PCT/EP2006/003948

§ 371 (c)(1),
(2), (4) Date: Jun. 23, 2008

(87) PCT Pub. No.: WO2006/122641

PCT Pub. Date: Nov. 23, 2006

(65) Prior Publication Data

US 2009/0126621 A1 May 21, 2009

(30) Foreign Application Priority Data

May 10, 2005 (EP) ..... 05010121

(51) Int. Cl.
*G04B 23/02* (2006.01)

(52) U.S. Cl. ..... 368/245; 368/243; 368/255

(58) Field of Classification Search ..... 368/101, 368/243–245, 255

See application file for complete search history.

(56) References Cited

U.S. PATENT DOCUMENTS

| | | | | |
|---|---|---|---|---|
| 4,352,961 | A * | 10/1982 | Kumada et al. | 455/350 |
| 4,639,903 | A * | 1/1987 | Redolfi | 367/131 |
| 5,117,403 | A * | 5/1992 | Eberl et al. | 367/175 |
| 5,189,646 | A | 2/1993 | Sako et al. | |
| 6,578,511 | B1 * | 6/2003 | Dexter et al. | 116/137 R |
| 6,796,265 | B1 * | 9/2004 | Dexter et al. | 116/137 R |
| 7,310,427 | B2 * | 12/2007 | Retchin et al. | 381/380 |
| 2005/0254778 | A1 * | 11/2005 | Pettersen et al. | 386/46 |

FOREIGN PATENT DOCUMENTS

| | | |
|---|---|---|
| EP | 1 134 547 A1 | 9/2001 |
| FR | 2 754 088 | 4/1998 |
| JP | 57-101786 | 6/1982 |
| JP | 60-1588 | 1/1985 |
| JP | 7-333359 | 12/1995 |

OTHER PUBLICATIONS

International Search Report issued in corresponding application No. PCT/EP2006/003948, completed Jul. 17, 2006 and mailed Jul. 25, 2006.

* cited by examiner

*Primary Examiner* — Sean Kayes
(74) *Attorney, Agent, or Firm* — Griffin & Szipl, P.C.

(57) ABSTRACT

The invention concerns a water resistant portable object such as a diving watch including a sound generator device (12) and a microprocessor (1), characterized in that it emits acoustic signals at two different frequencies ($f_1$) and ($f_2$) as a function of the medium, air or water, in which the wearer of the watch is situated.

11 Claims, 1 Drawing Sheet

WATER RESISTANT PORTABLE OBJECT INCLUDING A SOUND GENERATOR

This is a National Phase Application in the United States of International Patent Application No. PCT/EP2006/003948 filed Apr. 28, 2006, which claims priority on European Patent Application No. 05010121.1, filed May 10, 2005. The entire disclosures of the above patent applications are hereby incorporated by reference.

FIELD OF THE INVENTION

The present invention concerns a water resistant portable object that can be in the air or in water and includes a sound generator. In particular, the present invention concerns a diving watch including a sound generator device such as an electro-acoustic transducer.

BACKGROUND OF THE INVENTION

Human beings do not perceive sounds in the same way in the air and in water. However for obvious reasons of safety, the wearer of the watch must be able to be warned in an optimum manner whatever medium (air or water) he is in. This is particularly true when the wearer of the watch makes a submarine dive. It is vital that the diver is warned in sufficient time that his dive time is running out or that he has reached his maximum dive depth.

Diving watches are known from Japanese Patent Nos. JP 60-001588 and JP 07-333359 in the name of Seiko and JP 57-101786 in the name of Casio.

The electronic watch disclosed in JP Patent No. 60-001588 is capable of generating an acoustic time alarm and an acoustic depth alarm. The audible signal frequency is the same for both alarms. However, the features of the alarm (repetition frequency, sound length) are different depending upon whether it is the time alarm or the depth alarm.

The electronic watch disclosed in JP Patent No. 57-101786 includes a device that indicates the depth reached and generates an acoustic signal when this depth reaches a predetermined value.

The electronic watch disclosed in JP Patent No. 07-333359 includes means that detect whether the depth measurement has reached a predetermined value. An acoustic alarm is then produced and a hand is actuated.

The three aforecited documents all provide the possibility of producing an acoustic alarm when the wearer is making a submarine dive. However, none of these three documents discloses or suggests adapting the frequency of the alarm as a function of the medium (air or water) in which the user is located. It has been observed that the medium (air or water) in which the acoustic signal propagates and the auditory apparatus (external/internal ear or the bones of the cranial cavity in the case of submarine perception) act like filters as regards the signal. They form what is currently called a perception filter. An empirical curve can be obtained, which, depending upon the medium in which one is situated, indicates, for a given frequency, the difference between the acoustic power emitted and the acoustic power as it is perceived by the user. It will thus be noted that in the air, the sound perceived by the user is only very slightly attenuated by the perception filter in a broad frequency range comprised between 1 and 10 kHz. In water, sound transmission seems optimal at a frequency of the order of 800-1000 Hz with attenuation of the order of 40 dB. However, at a frequency two times higher, attenuation is greater than 60 dB.

It is thus an object of the present invention to provide a portable object such as a diving watch including a sound generator device which provides the user thereof with optimum sound perception whatever the medium in which the user is situated.

SUMMARY OF THE INVENTION

The present invention therefore concerns a water resistant portable object such as a diving watch characterized in that it is capable of emitting acoustic signals at two different frequencies depending upon the medium, air or water, in which the user is situated.

Owing to these features, the present invention provides a portable object such as a diving watch, which is able to warn the user thereof in an optimum manner, in whatever medium the user is situated. In particular, the sound frequency emitted when the user makes a submarine dive is selected to ensure that said user has the best auditory comfort possible. The same is true when the user is in the air.

It will be noted that the frequencies that ensure optimum sound perception depending upon whether the user is in the air or underwater are substantially different in that the propagation properties of a sound in these two mediums are obviously not the same, but also because the organs used by the user in the hearing process are not the same when the user is in the air or underwater. In the air, a person perceives sounds essentially via his external ear, whereas in water sounds are perceived more by means of the internal ear and the bones of the cranial cavity.

According to a first variant of the invention, the portable object includes a manual switch actuated by the user to indicate to a microprocessor that the watch is in the air or underwater. According to a second variant of the invention, the portable object includes means for detecting the medium in which it is located and which provide a signal for indicating to a microprocessor that said portable object is located in the air or respectively underwater. These detection means may be a water sensor or a pressure sensor, which, depending upon the pressure measured, indicates to the microprocessor that the portable object, for example the watch, is in the air or respectively underwater.

BRIEF DESCRIPTION OF THE DRAWINGS

Other features and advantages of the present invention will appear more clearly in the following detailed description of an example embodiment of a diving watch according to the present invention, this example being given purely by way of non-limiting illustration, with reference to the annexed drawing, in which.

DETAILED DESCRIPTION OF THE ILLUSTRATIVE EMBODIMENTS

The present invention proceeds from the general inventive idea that consists in providing a portable object such as a diving watch able to emit an alarm signal at two different frequencies depending upon whether the user is in the air, or respectively underwater, these two frequencies being selected to ensure that, whatever the medium in which the user is situated, he will be warned in an optimum manner. The watch according to the invention thus considerably increases the user's safety.

Figure 1:
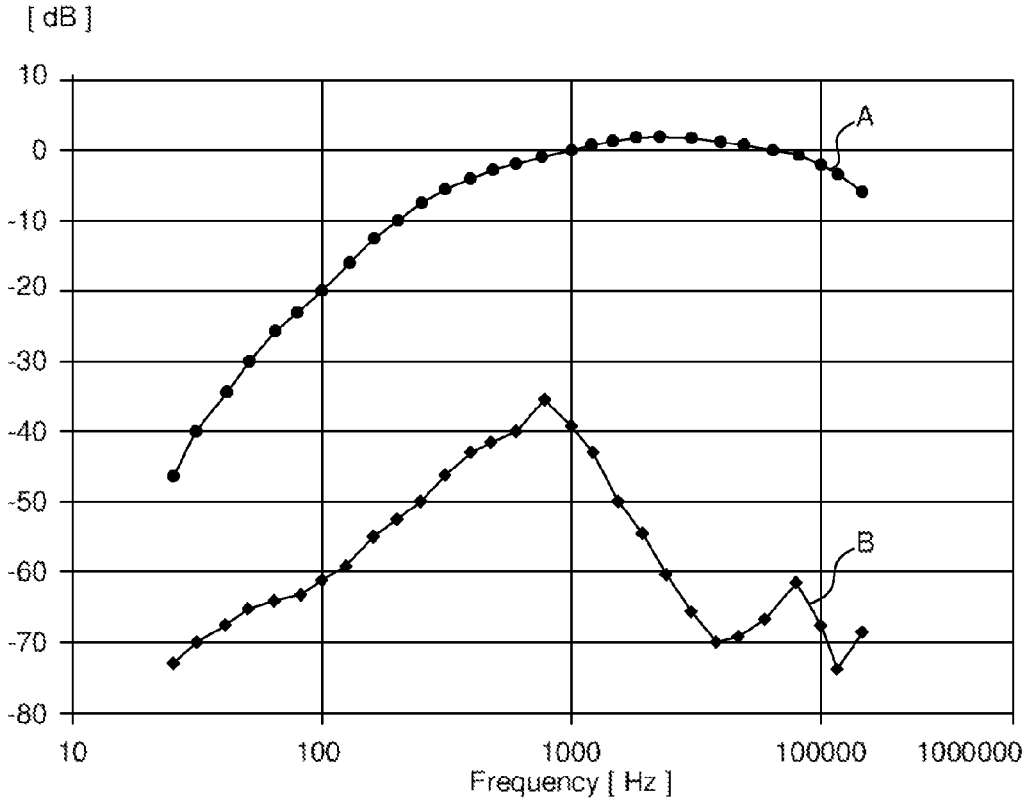
FIG. 1 is a graph that illustrates human acoustic perception in the air and underwater.

FIG. 1 is a graph that illustrates the differences in human acoustic perception in the air and underwater. This graph indicates, for a given hertz frequency placed on the x axis, the attenuation, expressed in decibels and placed on the y axis, between the acoustic power emitted and the acoustic power perceived by the user. Curve A illustrates the attenuation of sound when it propagates in the air. It will thus be noted that in the air, the sound perceived by a human being is only very slightly attenuated in a broad frequency range comprised between 1 and 10 kHz. This is explained by the fact that the medium, in this case the air, in which the sound is propagating and the auditory apparatus of the human being only slightly attenuate emitted sounds. In the water (see curve B), sound transmission is optimum at a frequency of the order of 800-1000 Hz, with attenuation of the order of 40 dB. The offset between the two curves A and B is partly explained by the fact that the reference acoustic pressure $P_0$ used for establishing these two curves is not the same for air as for water. In the air, $P_0$=20 μPa, whereas in water $P_0$=1 μPa. This offset is also explained by the fact that sound transmission phenomena are different depending upon whether one is in the air or underwater. Finally, the organs of a human being used in the hearing process are not the same depending upon whether the latter is in the air or underwater. In the air a person essentially perceives sounds by means of the external ear, whereas underwater sounds are perceived mainly by the internal ear and the bones of the cranial cavity.

Figure 2:
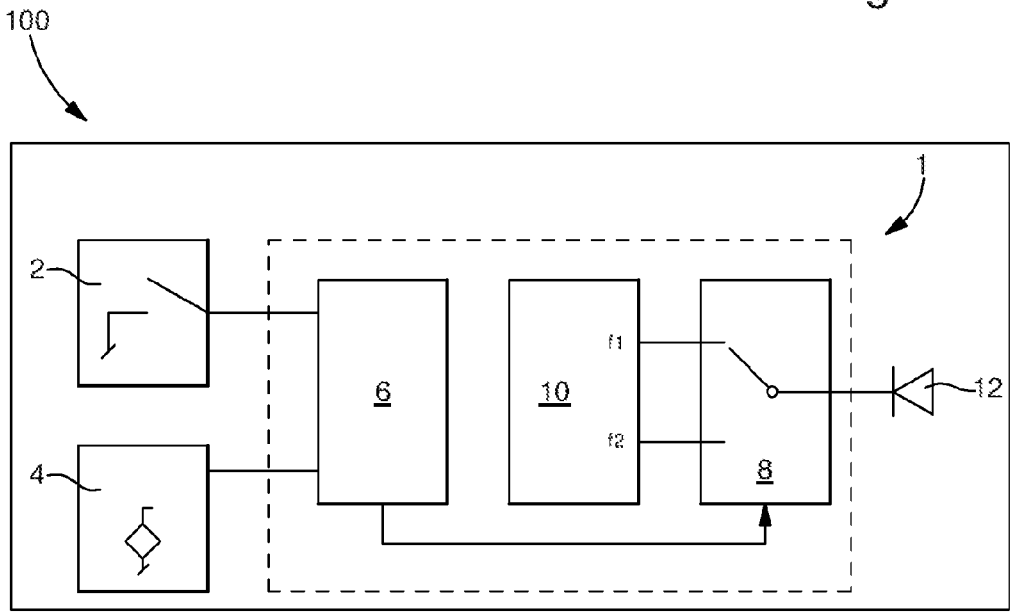
FIG. 2 is a flow chart of the electronic circuit of the watch.

FIG. 2 is a flow chart showing various electronic circuits of a water resistant watch 100 used by the present invention, such as a diving watch. The watch 100 essentially includes a microprocessor 1 one input of which is connected either to a manual switch 2, or to means for detecting the medium 4 in which the watch is located, such as a pressure sensor. Thus, according to the simplified variant of the invention, the wearer of the watch 100 actuates manual switch 2 between two stable states to indicate to the watch 100 microprocessor 1 that he is in the air or respectively underwater. According to the preferred embodiment of the invention, it is pressure sensor 4, which detects pressure variations linked to the change of medium that detects the medium.

Actuation of manual switch 2 or the pressure change detected by pressure sensor 4 generates an electric signal which is applied to the input of a state controller circuit 6. This electric signal will either take a high level, or a low level, depending upon whether the watch 100 is in the air, or respectively underwater. As a function of the high or low level of the electric signal produced by manual switch 2 or by pressure sensor 4, state controller circuit 6 will apply a control signal to the input of a frequency selector circuit 8. Via the effect of this control signal, frequency selector circuit 8 will select which of the two available frequencies $f_1$ or $f_2$ at the output of a frequency generator circuit 10 is applied to an acoustic transducer 12, such as a piezoelectric element.

It goes without saying that the present invention is not limited to the embodiment that has just been described and that those skilled in the art could envisage various simple alterations and variants without departing from the scope of the present invention defined by the annexed claims. In particular, it will be noted that although the present invention was described in relation to a diving watch, it could apply to other types of portable objects such as amphibious game, a water resistant camera, a depth meter or even a beeper. By way of example, the amphibious game could emit a melody which would be as easily perceived by the user in the air as underwater. In the case of a water resistant camera, the latter could emit two different sounds depending upon whether it is in the air or underwater, for example to indicate to the user that focussing has been carried out. The depth meter could indicate to the diver that he has reached the maximum dive threshold and have another function in the air. Finally, the beeper could warn a person on duty, just as efficiently, whatever the medium, air or water, in which the person is situated.

The invention claimed is:

1. A water resistant watch including:

(a) detection means for detecting a medium in which the water resistant watch is located, wherein the medium is selected from the group consisting of air and water;

(b) a microprocessor connected to the detection means, wherein the microprocessor selects one of first and second available frequencies, responsive to a signal generated from the detection means, wherein the signal indicates if the water resistant watch is in air or in water; and (c) a sound generator device connected to the microprocessor, wherein the sound generator emits a first acoustic signal having the first frequency when the water resistant watch is in the air and a second acoustic signal having the second frequency that is different from the first frequency when the water resistant watch is in the water, wherein the sound generator device and the microprocessor are both powered by an electric power source located inside the watch.

2. The watch according to claim 1, wherein the first frequency is comprised between 1 kHz and 10 kHz, and wherein the second frequency is comprised between 800 Hz and 1000 Hz.

3. The watch according to claim 2, wherein the watch further includes a manual switch actuated by a wearer of the watch to indicate to the microprocessor that the watch is in the air or respectively in the water.

4. The watch according to claim 2, wherein the detection means include a water sensor.

5. The watch according to claim 2, wherein the detection means include a pressure sensor which, as a function of the pressure measured, provides a signal to indicate to the microprocessor that the watch is in the air, or respectively in the water.

6. The watch according to claim 1, wherein the watch further includes a manual switch actuated by a wearer of the watch to indicate to the microprocessor that the watch is in the air or respectively in the water.

7. The watch according to claim 6, wherein actuation of the manual switch or the change in medium detected by the detection means generates an electric signal which is applied to an input of a state controller circuit, the state controller circuit applies, in response to the electric signal, a control signal to the frequency selector circuit, via the effect that a frequency selector circuit selects one or other of two available frequencies at the output of a frequency generator circuit, and the selected signal of frequency is finally applied to the sound generator device.

8. The watch according to claim 1, wherein the detection means include a water sensor.

9. The watch according to claim 1, wherein the detection means include a pressure sensor which, as a function of the pressure measured, provides a signal to indicate to the microprocessor that the watch is in the air, or respectively in the water.

10. The watch according to claim 1, wherein the sound generator device includes a piezoelectric transducer.

11. The watch according to claim 1, wherein the watch is a diving watch.

* * * * *